US005447300A

United States Patent [19]

Jünger

[11] Patent Number: 5,447,300

[45] Date of Patent: Sep. 5, 1995

[54] FEEDER FOR A PAPER SHEET-PROCESSING MACHINE

[75] Inventor: Arno Jünger, Mörlenbach, Germany

[73] Assignee: Heidelberger Druckmaschinen AG, Heidelberg, Germany

[21] Appl. No.: 135,249

[22] Filed: Oct. 12, 1993

[30] Foreign Application Priority Data

Oct. 10, 1992 [DE] Germany ..... 42 34 184.1

[51] Int. Cl.[6] ..... B65H 5/08

[52] U.S. Cl. ..... 271/11; 271/107; 271/108

[58] Field of Search ..... 271/4, 5, 11, 14, 93, 271/103, 107, 108

[56] References Cited

U.S. PATENT DOCUMENTS

| | | | |
|---|---|---|---|
| 3,702,698 | 11/1972 | Schwebel | 271/103 |
| 3,991,997 | 11/1976 | Barber | 271/108 |
| 4,717,138 | 1/1988 | Watkiss | 271/103 |
| 5,064,184 | 11/1991 | Liepert . | |
| 5,076,564 | 12/1991 | Marass | 271/11 |
| 5,137,267 | 8/1992 | Wirz et al. | 271/4 |

FOREIGN PATENT DOCUMENTS

| | | | |
|---|---|---|---|
| 3644201 | 7/1988 | Germany | 271/103 |

*Primary Examiner*—H. Grant Skaggs

*Attorney, Agent, or Firm*—Herbert L. Lerner; Laurence A. Greenberg

[57] ABSTRACT

A feeder for a sheet-processing machine includes at least one lifting sucker carried by a suction head for lifting a paper sheet from a sheet pile, a device for taking over the lifted paper sheet and for conveying the paper sheet from the lifted position thereof above the sheet pile to a sheet-processing unit, a device for applying a continuously acting force potential upon the lifting sucker downwardly in a direction towards the sheet pile, a suction device for cyclically controllably raising the lifting sucker in a direction opposing the force potential, the suction device being disposed rotationally symmetrically with respect to an axis of the lifting sucker, and being controllable for maintaining the lifting sucker in the raised position thereof on the suction head.

9 Claims, 5 Drawing Sheets

Fig.1
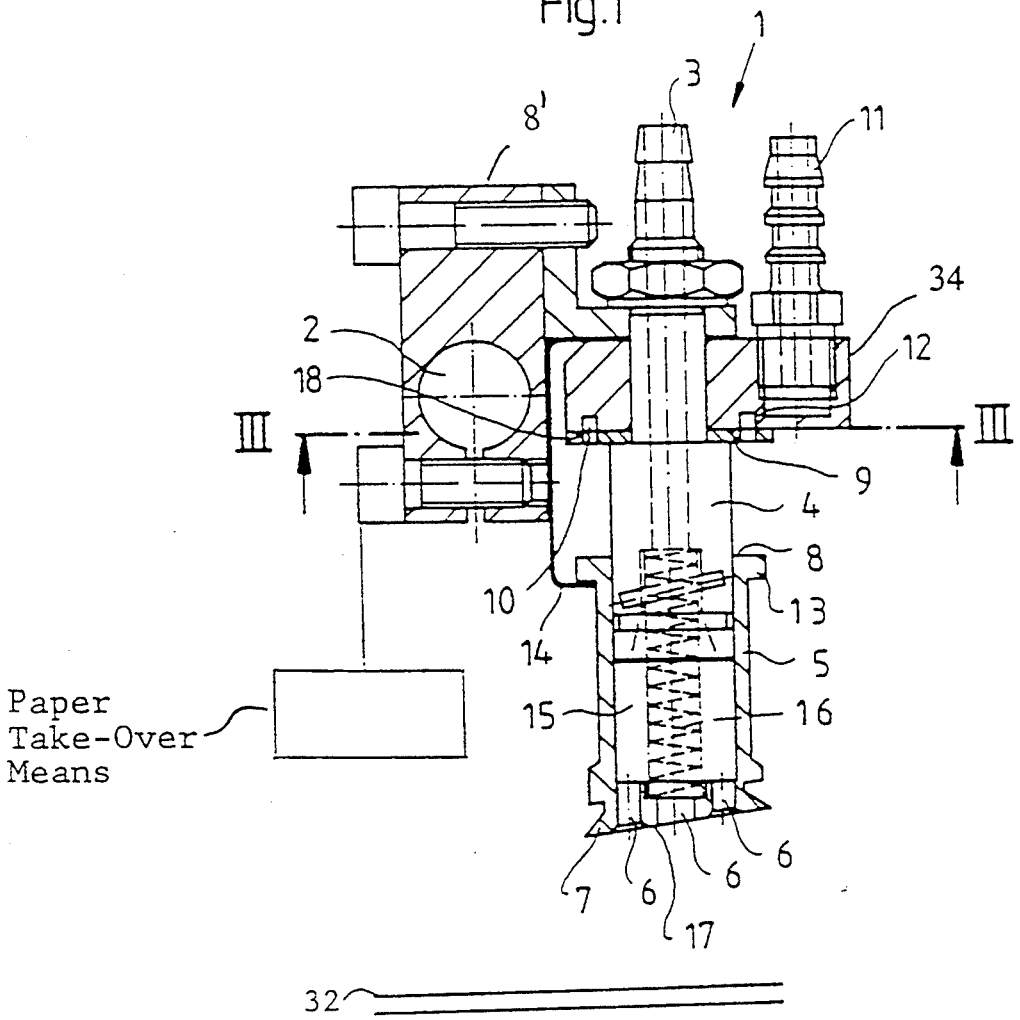
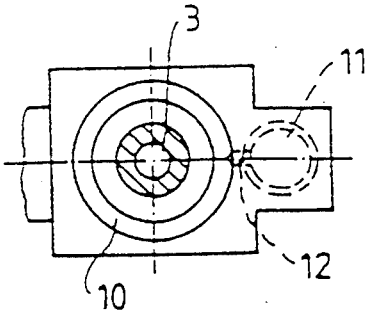
Fig.3

FEEDER FOR A PAPER SHEET-PROCESSING MACHINE

SPECIFICATION

The invention relates to a feeder for a paper sheet-processing machine.

Feeders for paper sheet-processing machines are known, wherein paper sheets are taken and lifted from a feed pile by means of lifting suckers and are then transferred to other conveying means downstream in the conveying direction, which then convey the paper sheets to paper sheet-processing machines, such as printing units of a printing press. It is important in this connection that the lifting suckers remain in lifted position until the trailing edge of the taken-up or accepted paper sheet has been moved out of the range of movement of the lifting sucker. Thereafter, the lifting suckers are lowered as rapidly as possible to lift the next paper sheet. Mechanical locking devices are known with which the lifting sucker remains secured above the paper sheet and is moved downwardly after the locking device has been released. Such mechanically elaborate locking devices are too sluggish, especially for fast-running machines. The locking operation and, primarily, the releasing operation, requires a great expenditure of time, so that the next following paper sheet can be lifted only after a delay, which results in a considerable reduction in the printing speed. If the lock is released too early, the lifting sucker may possibly touch the trailing edge of the sheet, because of which the latter can be damaged, or several of the paper sheets can be torn away from the following conveying means or at least shifted in the position thereof. This danger exists especially when forwarding or pull suckers are used as the following conveying means.

In order to effect a simple brief stopping of the lifting suckers, it has become known heretofore from the published former German Democratic Republic Patent Document 2 93 562 A5, to maintain the lifting sucker in its lifted position by means of suction air from an auxiliary suction line in a suction head, which acts upon a flat contact surface of the lifting sucker. When the trailing edge of the sheet, which was taken over by a forwarding or pull sucker, has passed beyond the range of movement of the lifting sucker, the suction air in this auxiliary suction line is interrupted and the lifting sucker can be rapidly lowered in a conventional manner to take up the next following paper sheet. The holding or gripping contact due to the suction effect between the suction head and the lifting sucker is, in this regard, provided by a suction line terminating outside of the lifting sucker axis in the contact surface between the suction head and the lifting sucker. This eccentric disposition of the suction line, along with the introduction of the suction force which acts almost exclusively on one point, allows for slight tilting or canting movements when the lifting sucker is stopped. For the very brief stopping or holding times to be maintained exactly, in the case of fast-running machines which must maintain the exactness of the smallest fractions of seconds, the maintenance of a precisely dimensioned stopping or holding effect with such a holding or stopping device is rendered exceedingly difficult. Because of the eccentric action of the force, there arises both a danger of tilting or canting, as well as a reduced accuracy of the plane-parallelism between the suction surfaces of the suction head and the lifting sucker. Moreover, the holding or stopping cam which, in the aforementioned published patent document of the German Democratic Republic is constructed asymmetrically to the lifting sucker axis, makes for additional problems regarding cant or tilt-free stopping or holding. In addition, the asymmetric cam prevents rotation of the lifting sucker around the lifting sucker axis which is individually adapted to the respective print order. The receiving or take-up plane of the lifting nozzles, which is usually formed with an inclination angle, can therefore not be matched to the respective print order in the position of the inclined plane.

It is accordingly an object of the invention to provide a feeder of a paper sheet-processing machine having a relatively simple, reactive stopping or holding device for the lifting sucker, having an effect which can be rapidly discontinued, and by means of which a cant or tilt-free, reliable, and brief stopping or holding of the lifting suckers in the lifted position thereof is optimally possible over a wide range of uses.

With the foregoing and other objects in view, there is provided, in accordance with the invention, a feeder for a sheet-processing machine, comprising at least one lifting sucker carried by a suction head for lifting a paper sheet from a sheet pile, means for taking over the lifted paper sheet and for conveying the paper sheet from the lifted position thereof above the sheet pile to a sheet-processing unit, means for applying a continuously acting force potential upon the lifting sucker downwardly in a direction towards the sheet pile, suction means for cyclically controllably raising the lifting sucker in a direction opposing the force potential, the suction means being disposed rotationally symmetrically with respect to an axis of the lifting sucker, and being controllable for maintaining the lifting sucker in the raised position thereof on the suction head.

The lifting sucker is exposed to a force potential which continuously acts downwardly for the purpose of lifting sheets. This continuously acting force potential permits a fast-reacting lowering of the lifting sucker after the lifting sucker has been released by the controlled suction means. With the controlled suction means, it is possible to hold back the lifting sucker against the action of the force potential which accelerates the lifting sucker downwardly. In the course thereof, the dynamically balanced or rotationally symmetrical disposition of the controlled suction means with respect to the lifting sucker permits cant or tilt-free stopping of the lifting sucker. The plane-parallelism between the contact or stop surface of the suction head and the contact or stop surface of the lifting sucker is further assured. Tilting or canting at the location at which the suction air is introduced between the surfaces due to the various forces acting axially upon the lifting sucker, and the torques or moments acting as a result thereof, can be considerably reduced. A stopping effect which is precisely defined in time is assuredly possible with such a construction. In addition, the suction force applied in a dynamically balanced or rotationally symmetrical manner permits turning or rotation of the lifting sucker about its axis without any reduction in the reliability with which the holding force is applied. It is therefore possible to process paper sheets of the most varied sizes or formats, the most varied types of paper and the most varied paper thickness, optimally in accordance with the print order, even at high speeds, by means of the individual adaptation of the inclined surface of the suction nozzles to the particular print job.

In accordance with another feature of the invention, rotationally symmetrical concentric stop surfaces respectively are formed on the suction head and on the lifting sucker and face towards one another, a suction-air feed channel is formed on the suction head, one of the stop surfaces being formed with a channel shaped as an annular groove, the suction-air feed channel having an opening by which the suction-air feed channel terminates in the annular groove-shaped channel.

Thus, a relatively simple and reliable, rotationally symmetrical or dynamically balanced distribution of the stopping force is permitted to be applied. The suction force is evenly distributed over the circumference of the lifting sucker. The embodiment is structurally simple and can be produced relatively economically.

In accordance with a further feature of the invention, the annular groove-shaped channel is formed in the stop surface on the suction head.

In accordance with an added feature of the invention, resilient sealing material is provided covering the stop surface on the lifting sucker.

In accordance with an additional feature of the invention, resilient sealing material is provided covering the stop surface on the suction head on both sides of the annular groove-shaped channel formed therein.

In accordance with yet another feature of the invention, the annular groove-shaped channel is formed in the stop surface on the lifting sucker. This construction is particularly advantageous from the standpoint of production techniques. In this regard, when the lifting suckers are molded of plastic, for example, the formation of the annular groove can be included in the molding process.

In accordance with yet a further feature of the invention, a resilient sealing layer is provided covering the stop surface on the suction head outside of the opening of the suction-air feed channel.

In accordance with yet an added feature of the invention, a resilient sealing layer is disposed on both sides of the annular groove-shaped channel formed in the stop surface on the lifting sucker.

In view of the the foregoing, a particularly assured even application of the stopping force is afforded, together with a particularly reliable avoidance of an excess of air effects. Furthermore, a particularly tight seal is afforded because of the increased surface pressure against the resilient sealing material in the edge region of the annular channel.

In accordance with yet an additional feature of the invention, there is provided a common unipartite suction channel with a common suction air control mounted in the suction head for lifting the paper sheets and for maintaining the lifting sucker in the raised position thereof, the common suction channel terminating in a first vacuum chamber disposed concentrically to the axis of the lifting sucker, the suction head serving as a fixed piston and the lifting sucker as a movable cylinder housing, the fixed piston and the movable cylinder housing defining therebetween a lift piston/cylinder chamber constituting a second vacuum chamber couplably connected to the first vacuum chamber and to the suction nozzles in the lifting sucker for gripping the paper sheets, and means for controllably coupling and decoupling the connection between the vacuum chambers in the raised position of the lifting sucker.

The latter construction permits, by relatively simple means, a reliable, brief stopping of the lifting sucker in its raised position, and an individual rotation or turning of the lifting sucker about the lifting sucker axis in accordance with the requirements of production techniques without a loss in the quality of the assured stopping or holding effect. In particular, only a single suction air control and suction air supply is required for raising the lifting sucker and stopping or holding the lifting sucker. Additional means can be omitted. In this regard, in the raised position of the lifting sucker, the first vacuum or underpressure chamber is disconnected from the second vacuum or underpressure chamber by means for uncoupling or decoupling the connection. Consequently, the full, stopping or holding vacuum or underpressure remains in the first vacuum or underpressure chamber, for which reason the lifting sucker remains, as well, in its raised position counter to the force potential. In the region of the lift nozzles, the vacuum or underpressure in the second vacuum or underpressure chamber is reduced because of faulty air slowly seeping through the paper, for example, due to which a lifting of the paper sheet with the aid of the following conveying means is possible. After removing the paper sheet from the stopping or holding effect of the lifting sucker, the second vacuum or underpressure chamber is provided with air, while the first vacuum or underpressure chamber continues to be charged with vacuum or underpressure. The lifting sucker continues to remain in the raised position. The instant the paper sheet has been moved beyond the range of movement of the lifting sucker, the first vacuum or underpressure chamber is provided with air via the suction air control. Due to the downwardly directed force potential, the lifting sucker is moved downwardly for the purpose picking up the next paper sheet.

In accordance with another feature of the invention, the first vacuum chamber is disposed above the second vacuum chamber and a connecting channel is provided between the first and second vacuum chambers, the lifting sucker being mounted on the first vacuum chamber and being displaceable in a direction towards the sheet pile, and a body is fastened on the lifting sucker, the body, in the raised position of the lifting sucker, being in close sealing contact with an opening of the connecting channel associated with the second vacuum chamber.

In accordance with a concomitant feature of the invention, means for actuating the suction air control are provided, comprising at least one turning valve fixed on a controllably driven shaft.

Other features which are considered as characteristic for the invention are set forth in the appended claims.

Although the invention is illustrated and described herein as embodied in a feeder of a paper sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a side elevational view, partly in section, of an embodiment of a lifting sucker unit according to the invention having two separate suction connectors;

FIG. 3 is a fragmentary cross-sectional view of FIG. 1 taken along the lines III—III in the direction of the arrows;

Figure 2:
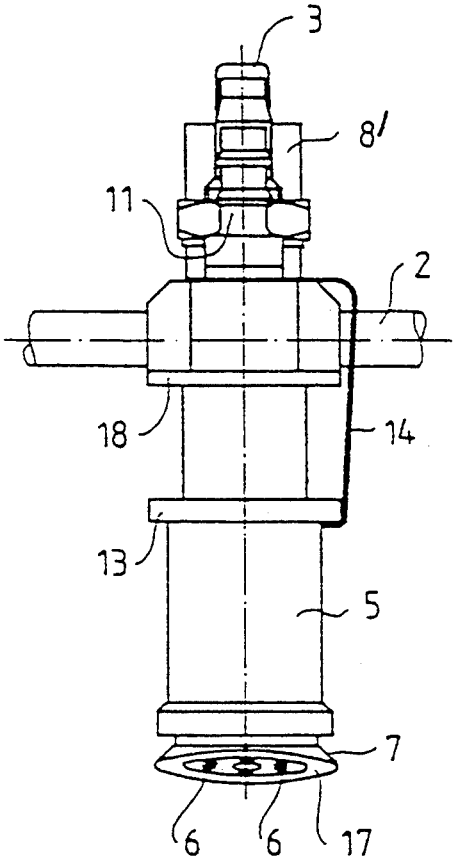
FIG. 2 is a front elevational view of FIG. 1 as seen from the right-hand side thereof, however, with a guide spring thereof slightly turned.
Figure 4:
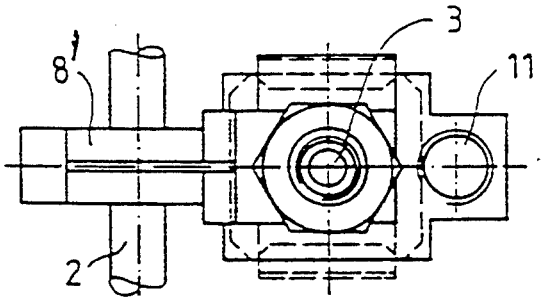
FIG. 4 is a top plan view of FIG. 1.
Figure 5:
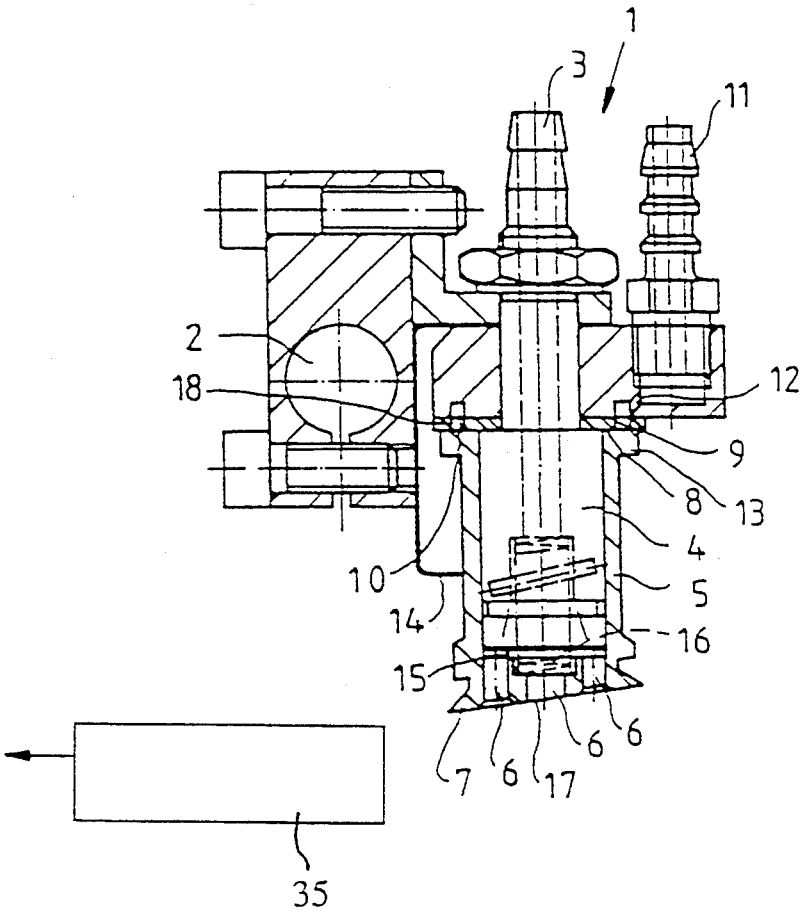
FIG. 5 is a view like that of FIG. 1 of the lifting sucker unit with a lifting sucker thereof in lifted or raised position.

Referring now to the drawings and, first, particularly to FIGS. 1 to 8 thereof, there are shown therein lifting sucker units 1 fastened in a conventional manner by a bracket 8′ onto a traverse or crosstie rod 2 extending transversely to a sheet-conveying direction of a sheet-fed printing press, for example, above a sheet feed pile 32, and fastened in a fragmentarily illustrated suction head 34. In a conventional manner, the lifting sucker units 1 are provided with a guide cylinder 4 fastened onto the crosstie rod 2. A lifting sucker 5 is mounted in a conventional manner on the guide cylinder 4 and is downwardly displaceable in a direction towards the feed pile 32. To raise the lifting sucker 5, a suction connector 3 of the guide cylinder 4 is charged with suction air in a conventional manner. A cylinder chamber 15 of the lifting sucker 5 and nozzles 6 are also charged with suction air in a conventional manner via a bore formed in the guide cylinder 4. After suction has been applied to paper sheets of the feed pile 32 through the nozzles 6, the lifting sucker 5 is raised against the force of a spring 16 as a result of the underpressure or vacuum present in the cylinder chamber 15. The lifting sucker 5 is raised from its position in FIG. 1 into a raised or lifted position thereof shown in FIG. 5. As shown diagrammatically in FIG. 5, the paper sheets raised by the lifting sucker 5 are transferred by suitable sheet take-over means 35 to a sheet-processing unit which is not illustrated.

At an upper edge of the lifting sucker 5, as shown in FIG. 1, for example, a stopping shoulder 13 is formed rotationally symmetrical or dynamically balanced concentrically with respect to the axis of the lifting sucker 5. The stopping shoulder 13 is formed with a flat contact or stop surface 8 facing upwardly in a direction towards the suction head 34 and extending over the entire circumference concentrically with and perpendicularly to the lifting axis of the lifting sucker 5. A contact or stop surface 9 corresponding to the stop surface 8 is formed on the suction head 34 and is located opposite from the stop surface 8. Lift travel is upwardly limited by the contact of the stop surface 8 with the stop surface 9, and in downward direction by a guide spring 14.

An annular groove 10 has been cut concentrically to the lifting sucker axis into the stop surface 9 in the suction head 34. The annular groove is connected via a connecting channel or conduit 12 with another suction connector 11 fastened onto the crosstie rod or beam 2.

After the lifting sucker 5 has lifted a paper sheet with the aid of the underpressure at the suction connector 3 until the stop surface 8 comes into contact with the stop surface 9, the suction connector 11 and thus the connecting conduit 12 and the annular groove 10 are charged with underpressure or vacuum. Even after the suction connector 3 has been provided with air, the lifting sucker 5 is maintained in the raised or lifted position thereof because of the underpressure present in the region of the annular groove between the stop surface 8 and the stop surface 9. In this regard, the suction connector 3 is provided with air the instant the paper sheet lifted by the lifting sucker 5 has been taken over by the following conveying means. The paper sheet is released by the lifting sucker 5 because of this aeration. The lifting sucker 5 remains in the raised position because of the underpressure in the annular groove 10. The instant the trailing edge of the lifted paper sheet has passed beyond the range of movement of the lifting sucker 5, the suction connector 11 is provided with air, and the annular groove 10 is provided with air via the connecting conduit or channel 12. The lifting sucker 5 moves downwardly due to the spring force of the spring 16 as well as due to its own weight so as to take over the next paper sheet.

A rubber seal or gasket 18 can be provided between the stop surface 9 and the stop surface 8 to improve the sealing effect. As shown in FIG. 1, the rubber gasket 18 can be affixed to the stop surface 9, an annular opening being formed in the rubber gasket 18 concentrically to and overlying the annular groove 10 formed in the stop surface 9. It is preferred, however, that the rubber gasket 27 be applied to the stop surface 8 of the lifting sucker 5. With this preferred construction, an improved sealing effect results because of the more advantageous surface pressure in the region of the annular groove 10. In this last-mentioned construction, of course, the gasket 18 need not be provided with any additional opening.

Figure 8:
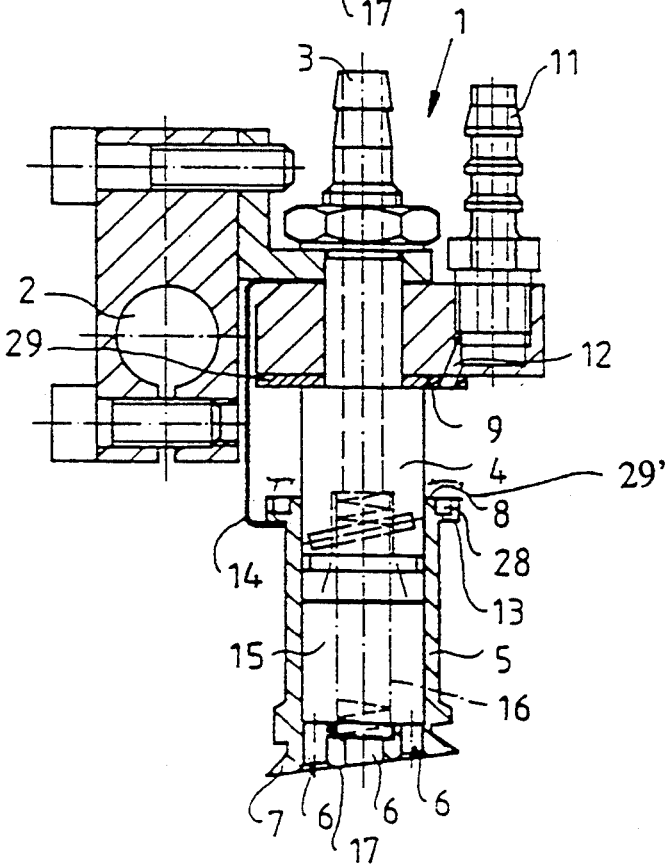
FIG. 8 is a view like that of FIGS. 1 and 7 of a third embodiment of the lifting sucker unit.

It is also conceivable to provide an annular groove 28 in the stop surface 8 of the lifting sucker 5, as shown in FIG. 8, in place of an annular groove 10 formed in the stop surface 9. Thus, in the construction of FIG. 8, it is necessary that, in the contact position of the stop surfaces 8 and 9, the connecting channel or conduit 12 terminate in the annular groove 28. As shown in FIG. 8, it is also possible to affix a ceiling layer or rubber gasket 29 to the stop surface 9 for improving the sealing effect. In this regard, a connecting opening from the suction channel or conduit 12 to the annular groove 28 must be provided in the rubber gasket 29. It is also conceivable, in this exemplary embodiment, to fasten the ceiling layer or rubber gasket 29′ to the stop surface 8 instead of the stop surface 9.

In this regard, it is necessary to provide, above the annular groove 28, openings to the annular groove 28, which are concentric to and congruent with the annular groove 28.

Suction via the annular groove makes possible an even force distribution over the entire circumference of the lifting sucker.

Figure 6:
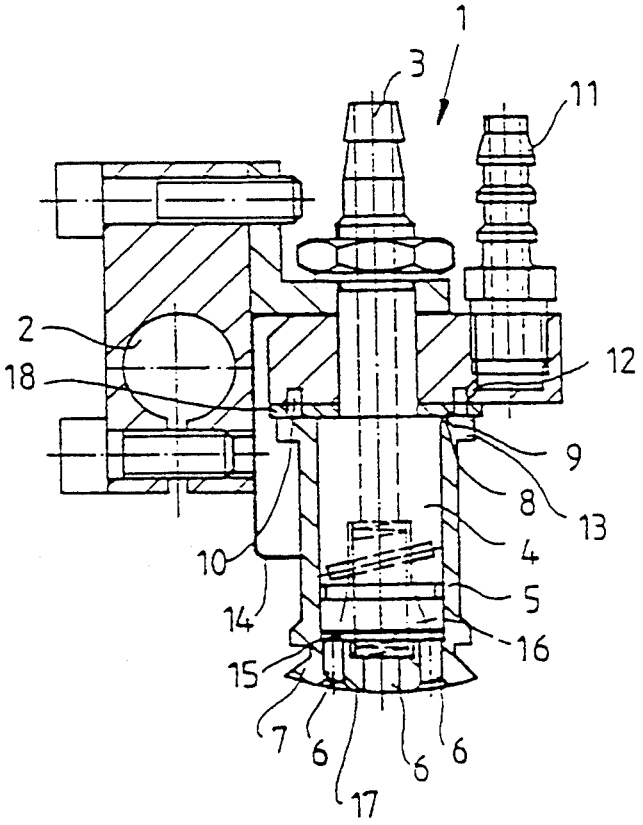
FIG. 6 is a view like that of FIGS. 1 and 5 of the lifting sucker unit with a lifting sucker thereof turned about its axis of lift.
Figure 7:
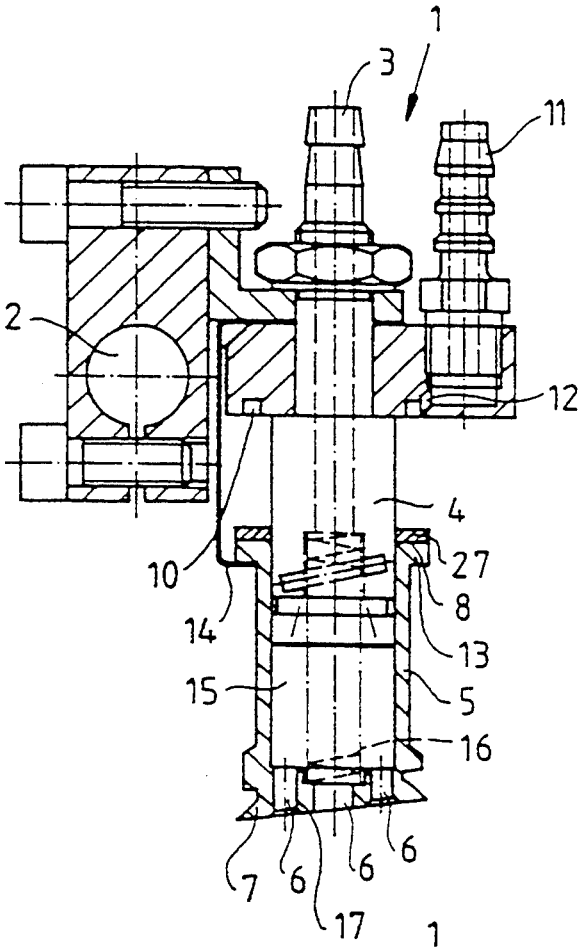
FIG. 7 is a view like that of FIG. 1 of another embodiment of the lifting sucker unit.

As shown in FIG. 6, it is also possible to turn or twist individually the lifting sucker 5 with its lift axis inclined obliquely to the sheet pile surface. The application and effect of the holding force introduced through the suction connector 11 are not impaired thereby.

Figure 9:
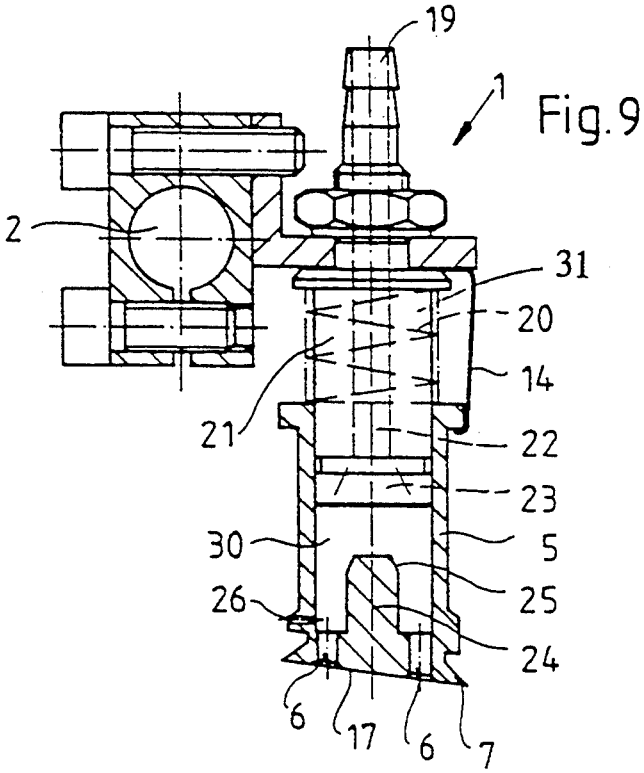
FIG. 9 is a view like that of FIGS. 1, 7 and 8 of a fourth embodiment of the lifting sucker unit having only one suction channel or conduit.
Figure 10:
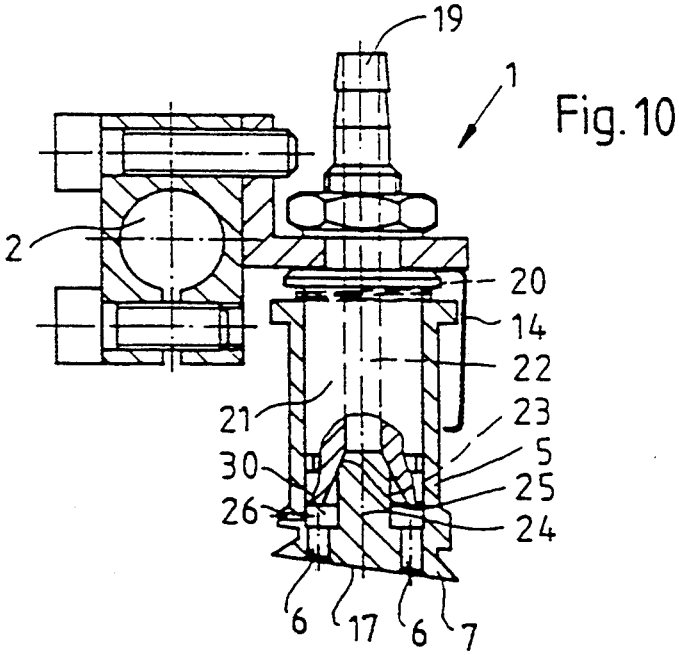
FIG. 10 is another view of FIG. 9 with the lifting sucker unit thereof in lifted or raised position.

Another exemplary embodiment is illustrated in FIGS. 9 and 10, wherein lifting sucker units 1 are also fastened, in a conventional manner, onto a crosstie rod 2 extending transversely to the sheet- conveying direction of a sheet-fed printing press above the non-illustrated feed pile, and fastened in the also non-illustrated suction head. In a conventional manner, the lifting sucker units 1 have a suction head or guide cylinder 21 formed with a first vacuum chamber 31 fastened onto the crosstie rod 2. A lifting sucker 5 formed with a second vacuum chamber 30 is also mounted, in a conventional manner, on the guide cylinder 21 and is downwardly displaceable in a direction towards the feed pile. To raise the lifting sucker 5, a suction connector 19 of the guide cylinder 21 is charged with suction air in a conventional manner. The second vacuum cylinder chamber 15 of the lifting sucker 5 and the nozzles 6 are also charged with suction air, in a conventional manner, via a suction channel or conduit 22 in the guide cylinder 21. The lifting sucker 5 is raised against the force of the spring 20, after suction has been applied to the paper sheets by the nozzles 6. The lifting sucker 5 is raised from its position in FIG. 9 into a raised position, as shown in FIG. 10. A cylindrical bolt extension 24 is fastened in the lifting sucker 5 concentrically to the lifting sucker axis. The bolt extension 24 is formed with an end section 25 tapering conically upwards, as viewed in FIG. 10. The suction channel or conduit 22 is formed with a conical opening 23 serving as air control in the vicinity of the lower end thereof. The aperture angle of the conical opening 23 corresponds to the aperture angle of the conical end section 25. The conical opening 23 and the conical end section 25, in the geometry thereof, are of such dimensions that, after the lifting sucker 5 is lifted into the raised position thereof shown in FIG. 10, a sealing contact between the conical opening 23 and the conical end section 25 is assured at the desired maximum height of the lifting sucker 5. In this regard, the lift travel is upwardly limited by the location of the contact stop, and downwardly limited by the guide spring 14.

The instant the lifting sucker 5 with the lifted paper sheet has reached its maximum height, i.e., the location at which a sealing contact between the conical end section 25 and the conical opening 23 occurs, the underpressure or vacuum remains unchanged in the suction channel or conduit 22, due to which the lifting sucker 5 continues to remain in its raised position. Because of natural faulty air effects in the vicinity of the lifting plane 17, the underpressure in the cylinder chamber 30 is reduced, so that the paper sheet can be taken over by the following conveying means and passed on when the stopping or holding contact between the lifting plane 17 and the paper sheet has been released. Because of the sealing contact between the conical end section 25 and the conical opening 23, the lifting sucker 5 remains in the raised position even after the paper sheet has been completely released. The instant the trailing edge of the farther-conveyed paper sheet has passed beyond the range of movement of the lifting sucker 5, the suction connector 19 is supplied with air. Due to the spring force of the spring 20, the lifting sucker 5 is moved downwardly in the direction of the sheet pile, while the sealing contact between the conical end section 25 and the conical opening 23 is released.

In this connection, it is conceivable, for improving the aeration of the cylinder chamber 30, to provide an exhaust channel or conduit 26 of relatively small diameter in the vicinity of the circumference of the cylinder chamber 30 below the conical end section 25. The exhaust channel 26 provides means for controllably coupling and decoupling the connection between the first and second vacuum chambers 31 and 30 by pressure equalization. In this regard, the exhaust channel or conduit 26 must be of such dimensions that raising of the lifting sucker 5 as far as the upper position is possible with reasonable assurance.

It is conceivable, in connection with both of the last-mentioned embodiments, to provide a suction air control with the aid of conventional rotary or turning valves, which are operated in the conveying cycle.

I claim:

1. A feeder for a sheet-processing machine, comprising at least one lifting sucker carried by a suction head for lifting a paper sheet from a sheet pile, means for taking over the lifted paper sheet and for conveying the paper sheet from the lifted position thereof above the sheet pile to a sheet-processing unit, means for applying a continuously acting force potential upon said lifting sucker downwardly in a direction towards the sheet pile, suction means for cyclically controllably raising said lifting sucker in a direction opposing said force potential, said suction means being disposed axially symmetrically with respect to an axis of said lifting sucker, and being controllable for maintaining the lifting sucker in said raised position thereof on said suction head, concentric stop surfaces respectively axially symmetrical to said axis of said lifting sucker being formed on the suction head and on said lifting sucker and facing towards one another, a suction connector formed on said suction head, one of said stop surfaces being formed with a channel shaped as an annular groove, said suction connector having an opening by which said suction connector terminates in said annular groove-shaped channel.

2. A feeder according to claim 1, wherein said annular groove-shaped channel is formed in said stop surface on said suction head.

3. A feeder according to claim 2, including a resilient sealing material covering said stop surface on said lifting sucker.

4. A feeder according to claim 2, including a resilient sealing material covering said stop surface on said suction head on both sides of said annular groove-shaped channel formed therein.

5. A feeder according to claim 1, wherein said annular groove-shaped channel is formed in said stop surface on said lifting sucker.

6. A feeder according to claim 5, including a resilient sealing layer covering said stop surface on said suction head outside of said opening of said suction-air feed channel.

7. A feeder according to claim 5, including a resilient sealing layer disposed on both sides of said annular groove-shaped channel formed in said stop surface on said lifting sucker.

8. A feeder according to claim 1, wherein said suction head is formed with a guide cylinder, and including a suction channel with an air control mounted in said suction head for lifting the paper sheets and for maintaining the lifting sucker in the raised position thereof, said suction channel terminating in a first vacuum chamber formed in said guide cylinder and disposed concentrically to the axis of said lifting sucker, said guide cylinder serving as a fixed piston and said lifting sucker as a movable cylinder housing, said fixed piston and said movable cylinder housing defining therebetween a lift piston/cylinder chamber constituting a second vacuum chamber couplably connected to said first vacuum chamber and to said suction nozzles in said lifting sucker for gripping the paper sheets, and means for controllably coupling and decoupling said connection between said vacuum chambers in the raised position of said lifting sucker.

9. A feeder according to claim 8, wherein said first vacuum chamber is disposed above said second vacuum chamber and a connecting channel is provided between said first and second vacuum chambers, said lifting sucker being mounted on said guide cylinder and being displaceable in a direction towards the sheet pile, and a body fastened on said lifting sucker, said body, in the raised position of said lifting sucker, being in close sealing contact with an opening of said connecting channel associated with said second vacuum chamber.

* * * * *